US005365620A

United States Patent [19]

MacLeod

[11] Patent Number: 5,365,620

[45] Date of Patent: Nov. 22, 1994

[54] OUTDOOR SHOWER APPARATUS

[76] Inventor: Robert P. MacLeod, 10 Main St., Ashburnham, Mass. 01430

[21] Appl. No.: 96,294

[22] Filed: Jul. 26, 1993

[51] Int. Cl.[5] ..... A47K 3/22

[52] U.S. Cl. ..... 4/615; 4/600

[58] Field of Search ..... 4/567, 615, 616, 617, 4/670, 599, 600, 602, 603, 900, 596

[56] References Cited

U.S. PATENT DOCUMENTS

| | | | |
|---|---|---|---|
| 1,330,312 | 2/1920 | Figueroa | 4/599 |
| 3,333,284 | 8/1967 | Symmons | 4/615 |
| 3,925,828 | 12/1975 | Kim | 4/599 |
| 4,934,001 | 6/1990 | Landketh | 4/615 |
| 4,975,992 | 12/1990 | Patterson et al. | 4/603 |
| 5,121,511 | 6/1992 | Sakamoto et al. | 4/615 |
| 5,239,712 | 8/1993 | Kinder | 4/606 |
| 5,287,569 | 2/1994 | Johnson | 4/599 |

FOREIGN PATENT DOCUMENTS

| | | | |
|---|---|---|---|
| 9308724 | 5/1993 | WIPO | 4/605 |

*Primary Examiner*—Ernest G. Cusick
*Assistant Examiner*—Gregory Vidovich
*Attorney, Agent, or Firm*—William F. Hamrock

[57] ABSTRACT

An outdoor shower apparatus having not only the well-known shower head but also a mixing valve for hot and cold water, in a kind of "bird house" appearance, and capabilities of being mounted for use that is selectively permanent or temporary.

14 Claims, 3 Drawing Sheets

OUTDOOR SHOWER APPARATUS

BACKGROUND OF THE INVENTION

There are many outdoor showers particularly at summer homes but they lack one attribute which is the application of hot water by a mixing valve and two connections to permanently mounted pipes, one cold water pipe and one hot water pipe.

It is the object of this invention to provide such a device but substantially permanently positioned in a spot outdoors where desired or near the hot and cold water supply pipes for easier setup. The shower apparatus is not portable. It has to be put up and taken down for seasonal use. On the other hand, it may be provided with indoor valves to be shut off for winter in which case this shower may be set up once and left there substantially permanently.

SUMMARY OF THE INVENTION

A case is provided for hiding the pipes within the device. There is a pair of spaced inlets in relation to the casing by which means the device is connected to interior or exterior sources of cold and hot water. The two pipes lead to a mixing valve which has the handle for actuating on the outside of the casing facing away from the building from which it is attached. The hot and cold water are mixed in this valve, and the water then proceeds by a single pipe to a built-in shower head which may or may not be movable the user wishes. It will be seen that it will be easier to place this device in a position where it is nearest to a hot water supply and this is one reason for the substantial permanency of positioning of the shower on the outside of a building. A special means is provided for hanging the device which is easily transported for winter storage if necessary. It is usual to have shutoff valves inside the house leading to the shower device so that the outdoor water supply may be shut off and the shower may be left in its outdoor position year round. In the latter case, it is preferable to have some kind of shroud to cover the substantially permanent shower casing during winter.

PREFERRED EMBODIMENTS OF THE INVENTION

Figure 1:
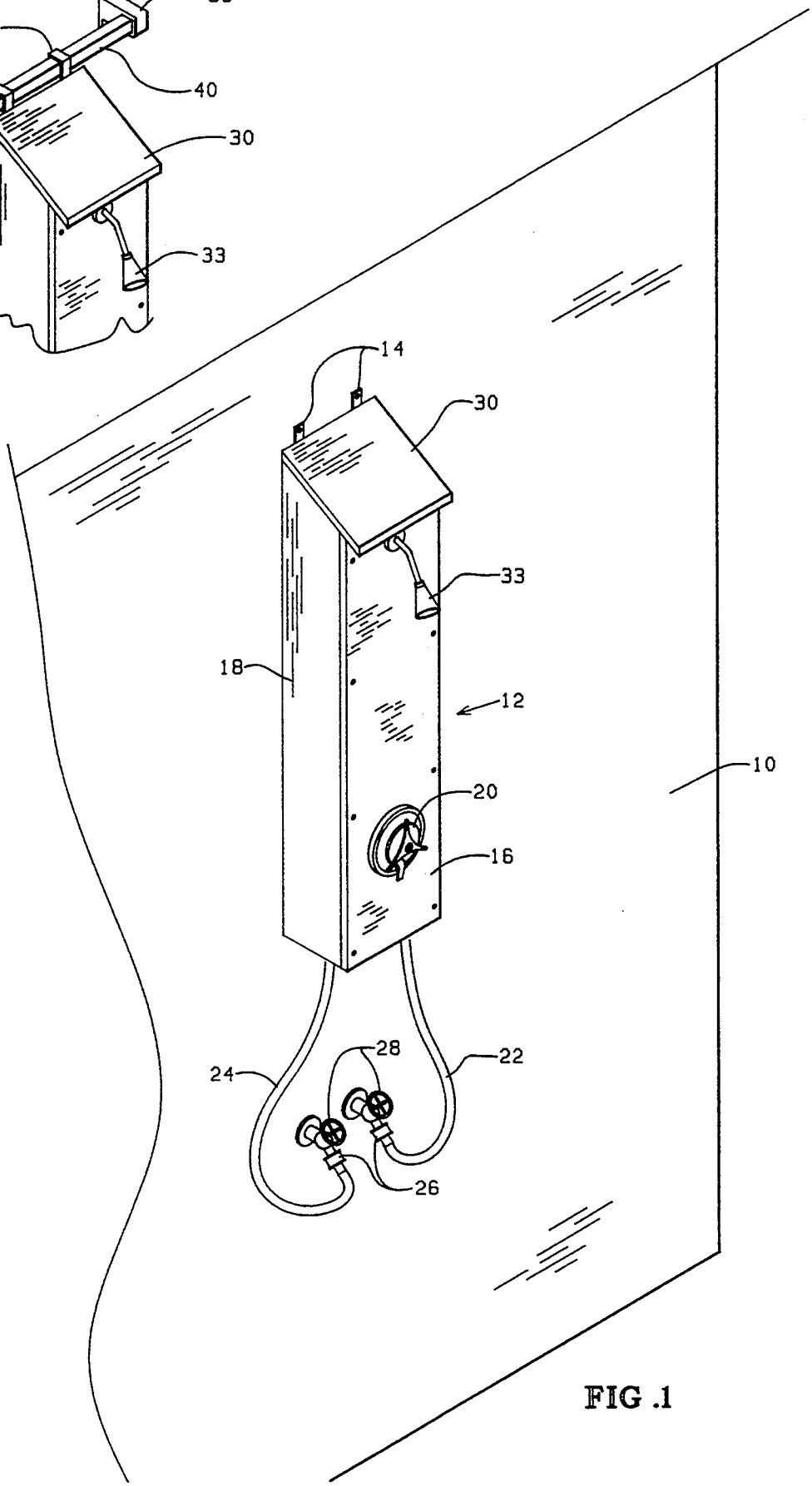
FIG. 1 is a perspective view of the invention mounted on an exterior wall.
Figure 3:
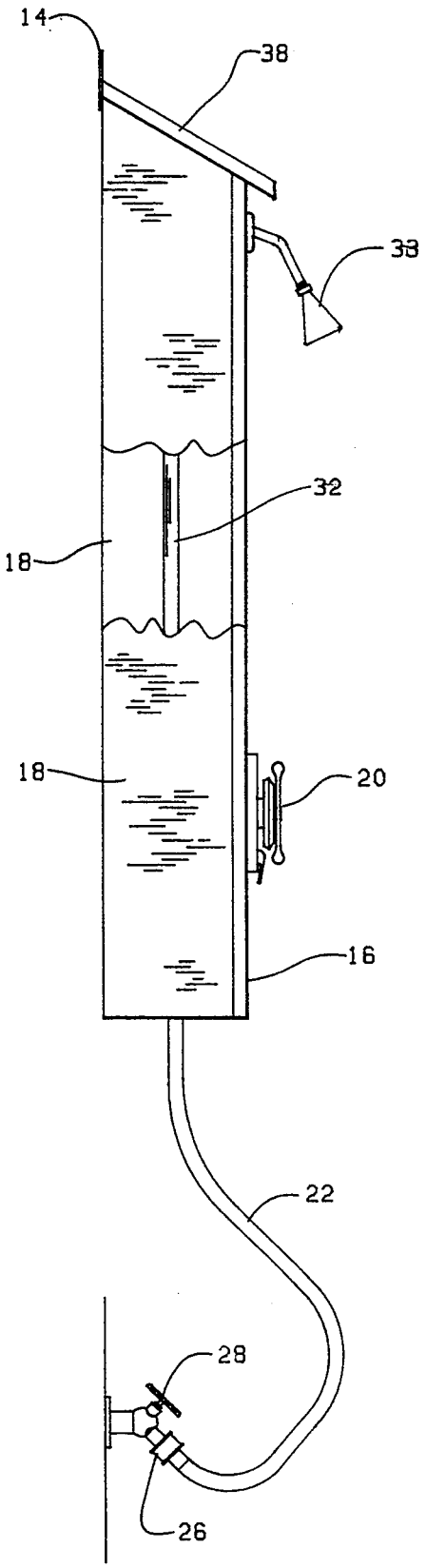
FIG. 3 is a side elevational view thereof.
Figure 2:
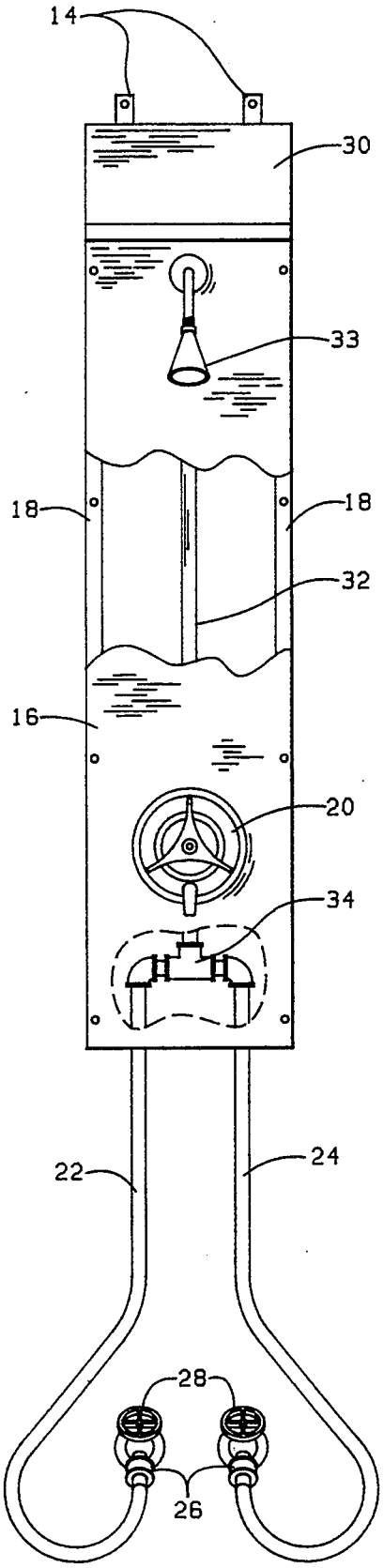
FIG. 2 is a front elevational view of the invention.

The reference numeral 10 in FIG. 1 indicates the exterior wall of a building and 12 indicates the housing of a box-like casing which is temporarily or substantially permanently attached to the exterior of the building on the wall 10, by means of tabs 14 and the corresponding wood screws. The case has a closed front member 16, a side wall 18, and another side wall 18 spaced from each other shown in FIGS. 2 and 3. The back of the case is open and being mounted on the wall 10 is closed by said wall. The mixing valve is shown at 20. The shower head 33 extends through the front member of the case 16 downwardly and is connected to the mixing valve 20 by a single pipe 32 as shown in FIGS. 2 and 3. The mixing valve has a double inlet 34 for both hot and cold water in flexible tubing 22, 24 at the lower end of which are provided temporary connections 26 for faucets 28 so that a person standing in front of the apparatus gets from the shower head the degree of heat that he desires by turning the mixing valve handle as shown in FIGS. 1, 2, and 3.

The top end of this case is closed by a slanting roof or end 30 so that the resulting case will blend in with bird houses and bird feeders as desired. The single pipe to the shower head is shown at 32 in FIGS. 2, 3 and the connections to the mixing valve are shown at 34 in FIG. 2.

Figure 4:
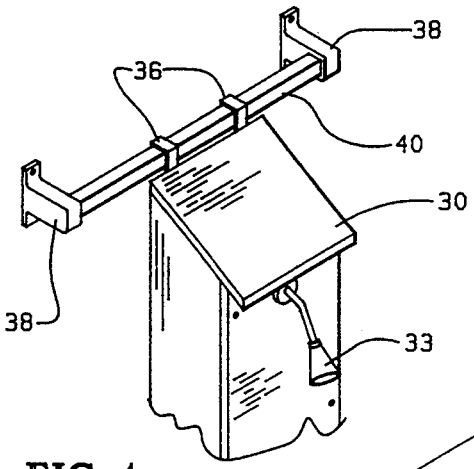
FIG. 4 is a perspective view of an alternative support.

FIG. 4 shows hooks 36 by which the device can be temporarily attached to the wall 10. These hooks extend in readily detachable relation to brackets 38 and bar 40 so that the flexible tubing 22, 24 can be detached from the faucets and the entire device carded into the house for the winter season.

Figure 6:
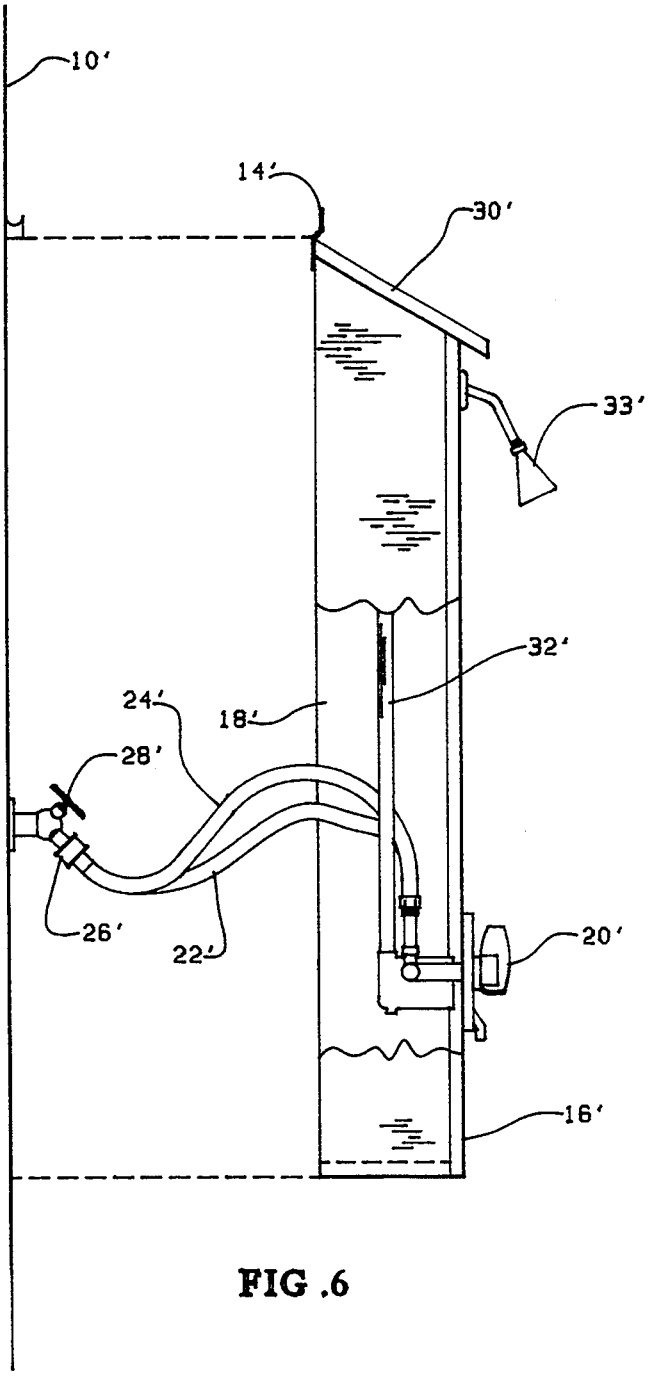
FIG. 5 and 6 are views similar to FIGS. 2 and 3 but showing a modification.
Figure 5:
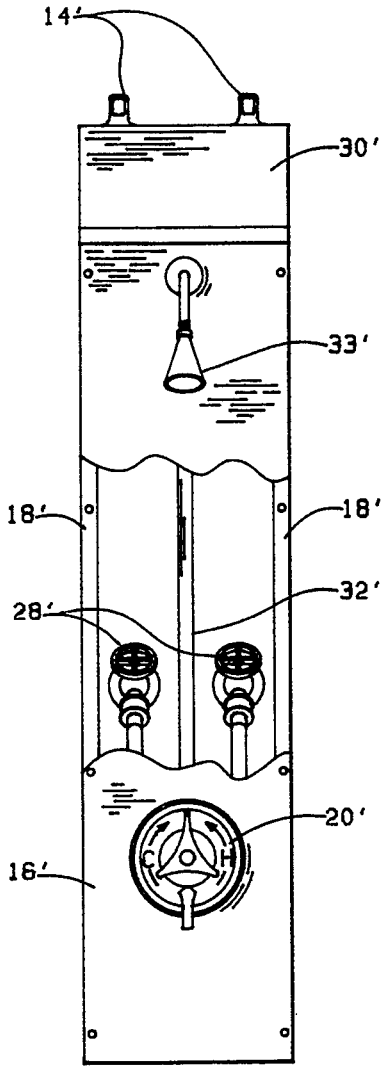

FIGS. 5 and 6 show a modification wherein all similar members are identified by the same characters as in FIGS. 1–3 inclusive but with the prime modicators. The difference is that the hot and cold water faucets are arranged on the wall in a different, high area that will be within its area of the open rear side of the box or enclosure housing the mixer valve and the shower head and this ensures that the hoses and faucets are hidden and the whole apparatus is more like the appearance of a bird house. Otherwise parts are the same and operate the same way.

The detachable outdoor shower is used to rinse off, primarily after swimming in the ocean, lakes, or pools, with mixed hot and cold water. It eliminates tracking sand or mud into dwellings with the comfort of an indoor shower. It mounts securely to the outside of a dwelling or other building and is easily disconnected in less than one minute. It is constructed of attractive cedar wood with a polyurethane finish, and has a commercial anti-scald mixing valve connected to hot and cold water outside water supply spigots using standard hose connections.

FIGS. 5 and 6 show a modification wherein by arranging both hot and cold water sources on the wall in a pre-selected area so that these sources lie within the area of the main enclosure, and providing very short hoses also within the enclosure, the sources and hoses are completely hidden form view. The similarity to a bird house in enhanced and the overall appearance is rendered much neater since the modification of FIGS. 2 and 3 with relation to FIGS. 5 and 6 is so close the same numerals have been applied to similar parts of the device, but in FIGS. 5 and 6 the numbers have been primed and any explanation of the numerals of FIGS. 5 and 6 is the same explanation of FIGS. 2 and 3 but are distinguished by primed numeral.

I claim:

1. A substantially permanently positioned shower for disposition outside of a house or building having hot and cold water supply sources located on an exterior wall of the house or building, said shower comprising a casing adapted to be mounted on an exterior wall of the house or building, said casing having a shower head and a mixing valve with a handle and dial for mixing water mounted thereon said shower head being operatively connected to said mixing valve, said mixing valve having two pipes connected thereto, one for cold water, and one for hot water, connection means for each of these pipes adapted to be connected to said hot and cold water supply sources, respectively;

said casing comprising a front member in which the shower head and the handle and dial for the mixed water are mounted, the mixing valve being located below the shower head, said casing having an open back so that the shower head, the pipes and the mixing valve are readily accessible for maintenance, the casing having a closed top and a selective mounting means for detachably mounting the shower to the wall in position where the shower can be manually dissociated from the water supply sources and where access to the water supply sources is restricted by completely encasing said hot and cold water sources and said two pipes between said casing and said exterior wall.

2. The shower according to claim 1 wherein said water supply sources are water pipes set on the exterior wall.

3. The shower according to claim 1 wherein said water supply sources are water faucets set on the exterior wall.

4. The shower according to claim 1 wherein the mounting means are connected at a top portion of the casing.

5. An outdoor shower bath construction comprising an elongated casing, said casing having a closed top member, side members, a closed front member and an open back side, the front member having a shower head externally mounted thereon and a commercial mixing valve mounted thereon internally within the casing and a single pipe leading from the mixing valve to the shower head, a pair of detachable flexible connections, one for connecting a hot water supply source to said mixing valve and one for connecting a cold water supply source to said mixing valve, both sources being located on an exterior wall of a building structure, a means connected to said casing for detachably mounting the entire casing on said wall with the open back side of the box adjacent and contacting the wall when mounted thereon, the flexible connections to the mixing valve capable of being detachable from the hot and cold water supply sources, the shower construction being constructed and arranged to mount on said wall so that access to the supply sources is restricted by completely encasing said hot and cold water supply sources and said flexible connections within said casing, wherein the open back side of the casing is closed by the wall of the building when mounted thereon so that the closed front member faces outwardly with respect to said wall with the shower head extending into an operable position for a person standing in front of the casing.

6. The construction according to claim 5 wherein the flexible connections comprise flexible piping.

7. The construction according to claim 6 wherein said water supply sources comprise water faucets.

8. The construction according to claim 5 wherein said water supply sources comprise water faucets.

9. An outdoor shower system that comprises a combination of an exterior wall of a building having hot and cold water supply sources located on an exterior wall of the building, and a box-like enclosure including a top, a bottom, a front and side elements and an open back, a shower head and a dual heat mixing valve mounted on the front element wherein said valve is located within said enclosure, a single pipe connection from the valve to the shower head, two pipes connected to the mixing valve, one of said pipes releasably connected to said source of hot water and the other of said pipes releasably connected to said source of cold water, The open back of the box-like enclosure facing and contacting the wall, said two pipes to the mixing valve from the water sources extending through said open back of the enclosure, and means adapted to releasably secure the enclosure to the wall whereby access to the water supply sources is restricted by completely encasing said hot and cold water supply sources and said two pipes within said enclosure.

10. The outdoor shower system of claim 9 wherein the water sources are located on the wall within the confines of the enclosure, being completely hidden from view thereby.

11. The system of claim 10 wherein the water sources are placed in pre-selected positions that are completely in the enclosure once set in position on the wall.

12. The system according to claim 9 wherein said sources of water comprises water faucets.

13. The system according to claim 9 wherein said sources of water comprises water pipes.

14. The system according to claim 9 wherein said two pipes comprises flexible piping.

* * * * *